US007866479B2

(12) United States Patent
Fan

(10) Patent No.: US 7,866,479 B2
(45) Date of Patent: Jan. 11, 2011

(54) SPRING TYPE PAPER CUSHION

(76) Inventor: Yu-Han Fan, No. 227, Gong 5th Rd., Longtan Hsiang, Taoyuan Hsien (TW)

( * ) Notice: Subject to any disclaimer, the term of this patent is extended or adjusted under 35 U.S.C. 154(b) by 0 days.

(21) Appl. No.: 12/432,157

(22) Filed: Apr. 29, 2009

(65) Prior Publication Data

US 2010/0276331 A1 Nov. 4, 2010

(51) Int. Cl.
*B65D 81/02* (2006.01)
*B65D 85/30* (2006.01)

(52) U.S. Cl. ..... 206/588; 206/320; 206/586; 206/592

(58) Field of Classification Search ..... 206/305, 206/320, 453, 521, 586, 588, 590–592
See application file for complete search history.

(56) References Cited

U.S. PATENT DOCUMENTS

| | | | | |
|---|---|---|---|---|
| 3,240,417 | A * | 3/1966 | Andreini | 206/592 |
| 5,341,931 | A * | 8/1994 | Prochaska et al. | 206/592 |
| 5,732,818 | A * | 3/1998 | Koehn | 206/586 |
| 2010/0072096 | A1 * | 3/2010 | Wu et al. | 206/453 |

* cited by examiner

*Primary Examiner*—Byron P Gehman
(74) *Attorney, Agent, or Firm*—patenttm.us

(57) ABSTRACT

A spring type paper cushion having a columnar body, at least four cushioning recesses, at least four projections and a receiving portion. The columnar body has a columnar wall and an axis. The cushioning recesses and the projections are formed on the columnar wall. The projections are respectively located between two of the cushioning recesses. The receiving portion is recessed into the columnar wall and is located at one of the cushioning recesses. The receiving portion has two receiving mountain-fold lines, two slits and a bottom. The slits are cut so that the two receiving mountain-fold lines can be folded allowing the bottom to sink into the body.

1 Claim, 3 Drawing Sheets

SPRING TYPE PAPER CUSHION

BACKGROUND OF THE INVENTION

1. Field of the Invention

The present invention relates to a paper cushion, especially to a spring type paper cushion for packing and protecting an electrical appliance during a shipping process.

2. Description of the Prior Art

When shipping, vulnerable products such as electrical appliances may be damaged due to shock and vibration. To reduce damage, cushioning means are employed to protect the products. Due to the raising prices of and environmental issues relevant to petrochemical materials like EPE, paper materials tend to be applied as a trend. However, a conventional paper cushion is structurally complicated, difficult to make and less effective when holding a heavy product. Furthermore, a conventional paper cushion falls apart and crashes easily upon impact.

To overcome the shortcomings, the present invention provides a spring type paper cushion to mitigate or obviate the aforementioned problems.

SUMMARY OF THE INVENTION

The main objective of the invention is to provide a spring type paper cushion that bears continuous shock and vibration while being structurally simple and available at low manufacture costs.

The paper cushion in accordance with the present invention has a columnar body, at least four cushioning recesses, at least four projections and a receiving portion. The columnar body has a columnar wall and an axis. The cushioning recesses and the projections are formed on the columnar wall. The projections are respectively located between two of the cushioning recesses. The receiving portion is recessed in the columnar wall and is located at one of the cushioning recess. The receiving portion has two receiving mountain-fold lines, two slits and a bottom. The slits are cut open so that the two receiving mountain-fold lines are folded allowing the bottom to sink into the body.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
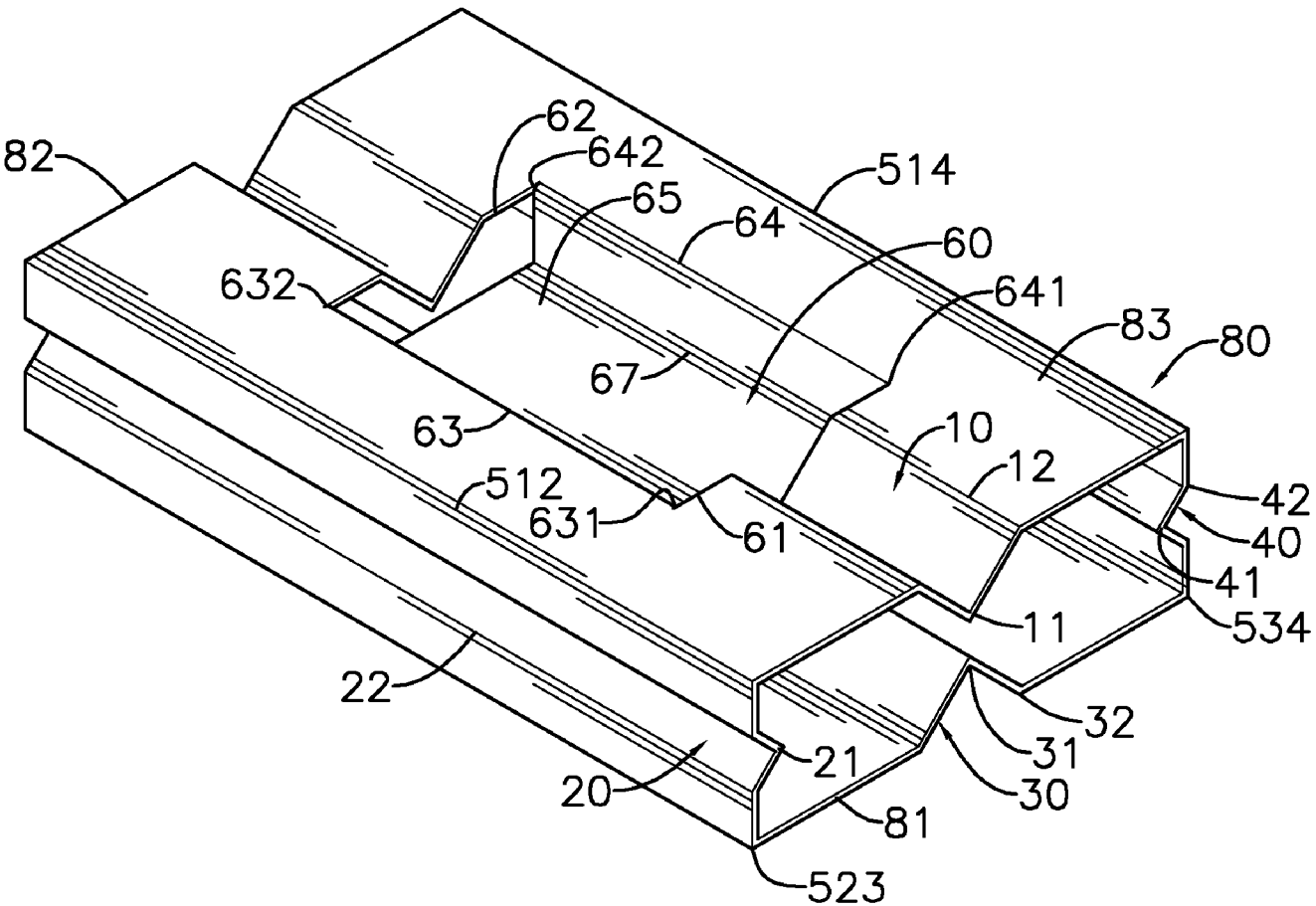
FIG. 1 is a perspective view of a paper cushion in accordance with the present invention.

With reference to FIG. 1, a paper cushion in accordance with the present invention comprises a columnar body (80), at least four cushioning recesses (10, 20, 30, 40), at least four projections (512, 523, 534, 514) and a receiving portion (60).

The columnar body (80) comprises a body first end (81), a body second end (82), a columnar wall (83) and an axis. The body (80) is made of paper. In a preferred embodiment, the body (80) is made of corrugated cardboard. A feasible method for making the columnar body (80) with a flat paper material comprises forming the columnar wall (83) from at least one bonded flat paper material to make the body (80). A junction is formed on the columnar wall (83) of a body (80) made with such method.

Another feasible method for making the columnar body (80) comprises producing paper tubes and cutting the paper tubes at a predefined length to obtain the columnar body (80). This method continuously produces the elongating columnar paper material and is suitable for mass production. The aforementioned methods for making the columnar body (80) demonstrate that various methods may be used to make the body (80). Even though different methods may give slight differences on the body (80), such slight differences do not depart from the scope of the present invention.

The paper cushion may comprise four cushioning recesses (10, 20, 30, 40). The four cushioning recesses (10, 20, 30, 40) are formed on the columnar wall (83). Each cushioning recess (10, 20, 30, 40) forms a v-shaped section and comprises a cushioning valley-fold line (11, 21, 31, 41) and two cushioning mountain-fold lines (12, 22, 32, 42). The inward or out ward folding directions are based on an outer surface of the columnar wall (83). A line on the columnar wall (83) being folded and forms an angle into the body (80) defined as a valley-fold line herein. On the other hand, a line on the columnar wall (83) being folded out from the body (80) is defined as a mountain-fold line herein. The cushioning valley-fold line (11, 21, 31, 41) is folded inwards parallel to the axis of the body (80). The two cushioning mountain-fold lines (12, 22, 32, 42) are folded outwards parallel to the cushioning valley-fold line (11, 21, 31, 41) and respectively located beside the cushioning valley-fold line (11, 21, 31, 41).

In a feasible embodiment, more than four cushioning recesses (10, 20, 30, 40) may be formed on the columnar wall (83).

When the body (80) is impacted, each cushioning recess (10, 20, 30, 40) temporarily deforms. A cushioning function similar to a spring is provided with such responsive actions. Unlike conventional paper cushions, the paper cushion in accordance with the present invention is designed to receive shocks repeatedly without dissembling since folding angles of the cushioning valley-fold lines (11, 21, 31, 41) and cushioning mountain-fold lines (12, 22, 32, 42) change and absorb shock.

The paper cushion in accordance with the present invention may comprise four projections (512, 523, 534, 514). The four projections (512, 523, 534, 514) are formed on the columnar wall (83). Each projection (512, 523, 534, 514) is respectively located between two of the cushioning recesses (10, 20, 30, 40). Forming four projections (512, 523, 534, 514) on the columnar wall (83) makes the body (80) to be a rectangular column that is suitable for shipping or storage.

Figure 2:
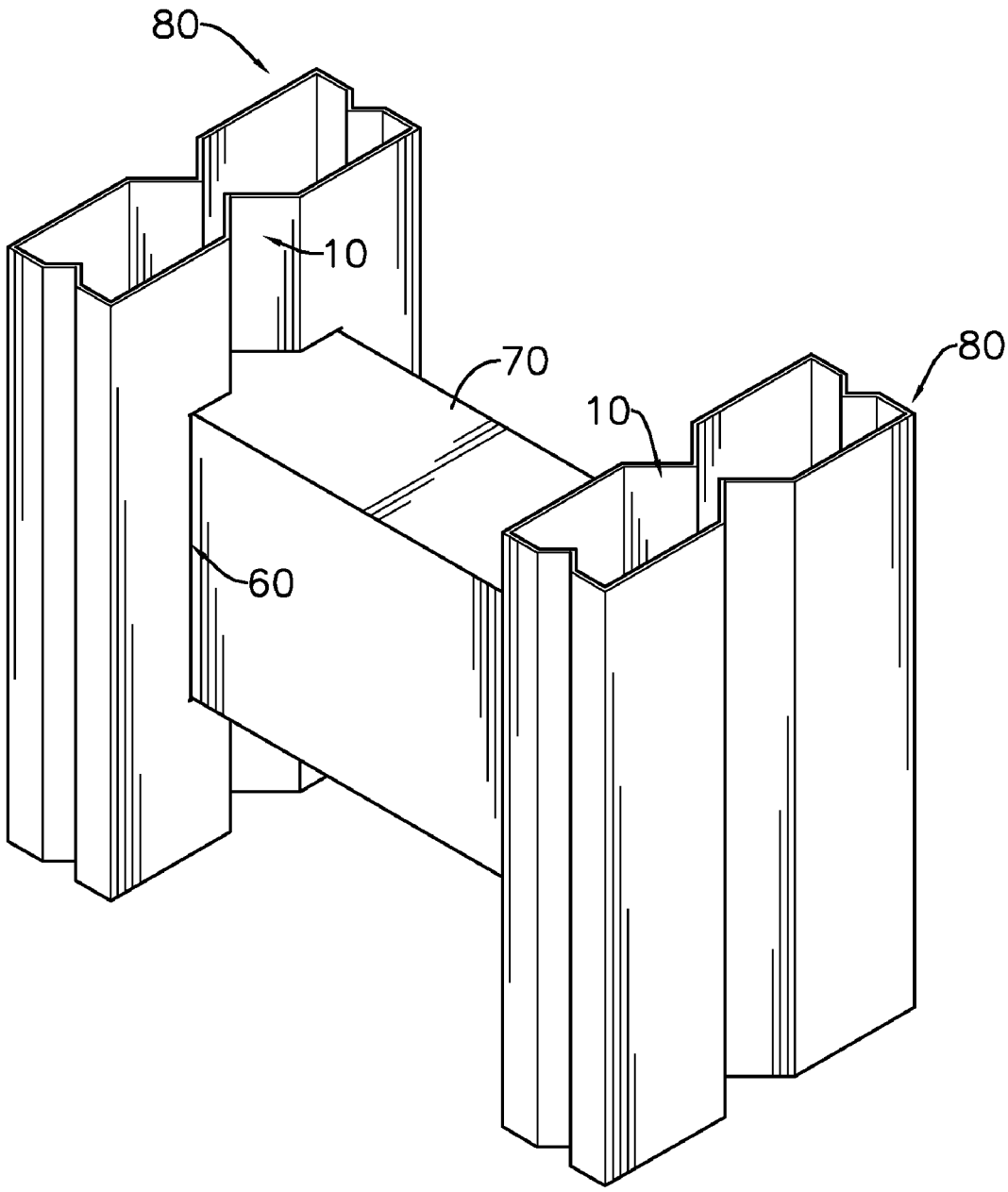
FIG. 2 is a perspective view of two paper cushions in FIG. 1 holding an electrical appliance.
Figure 3:
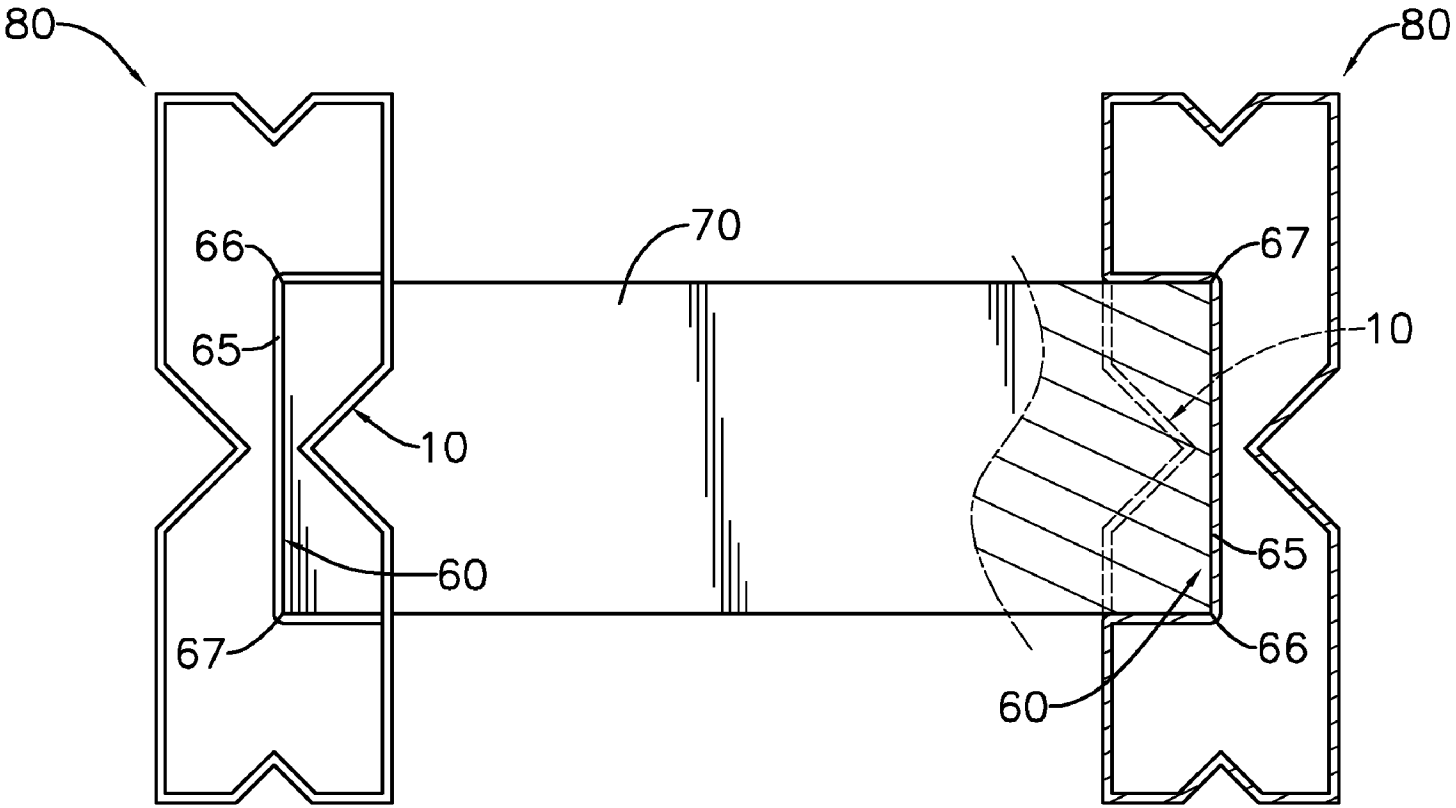
FIG. 3 is a partial sectional top view of the paper cushions in FIG. 2.

With reference to FIGS. 2 and 3, the receiving portion (60) is used to hold an electrical appliance such as a disc drive or a notebook computer and to provide cushioning for the electrical appliance. The receiving portion (60) recesses into the columnar wall (83), is located at one (10) of the cushioning recesses (10, 20, 30, 40) and comprises two receiving mountain-fold lines (63, 64), two slits (61, 62) and a bottom (65). In a feasible embodiment, the receiving portion (60) is located at a center of the cushioning recess (10).

The two receiving mountain-fold lines (63, 64) flank the cushioning recess (10) parallel to the cushioning mountain-fold lines (12, 22, 32, 42) on the columnar wall (83). Each of the two receiving mountain-fold lines (63, 64) comprises a receiving mountain-fold first end (631, 641) and a receiving mountain-fold second end (632, 642).

One of the two slits (61, 62) connects the receiving mountain-fold first ends (631, 641) of the two receiving mountain-fold lines (63, 64). The other of the two slits (61, 62) connects the receiving mountain-fold second ends (632, 642) of the two receiving mountain-fold lines (63, 64).

The bottom (65) is located amongst the two receiving mountain-fold lines (63, 64) and the two slits (61, 62) and formed on the columnar wall (83). The two slits (61, 62) are cut through the columnar wall (83) to allow the two receiving mountain-fold lines (63, 64) to be mountain-folded so that the bottom (65) sinks into the body (80) for receiving an electrical appliance in need of cushioning. The bottom (65) comprises two receiving valley-fold lines (66, 67). The two receiving valley-fold lines (66, 67) are parallel to the two receiving mountain-fold lines (63, 64). The two receiving valley-fold lines (66, 67) may be valley-folded so that the bottom (65) fit the electrical appliance better.

The paper cushion in accordance with the present invention provides cushioning function with a simple structure. The paper cushion is easily-made, low-cost and absorbs shock to a considerable extent, which is suitable for protecting an electrical appliance and reduces damage during shipping.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A paper cushion comprising a columnar body comprising a body first end;

a body second end;

a columnar wall;

an axis;

at least four cushioning recesses formed on the columnar wall and each comprising a cushioning valley-fold line folded inwards parallel to the axis of the body;

two cushioning mountain-fold lines folded outwards parallel to the cushioning valley-fold line and respectively located beside the cushioning valley-fold line;

at least four projections formed on the columnar wall and each respectively located between two of the cushioning recesses;

a receiving portion recessing into the columnar wall, located at one of the cushioning recesses and comprising two receiving mountain-fold lines folded outwards and flanking the one cushioning recess parallel to the cushioning mountain-fold lines on the columnar wall and each comprising a receiving mountain-fold first end;

a receiving mountain-fold second end;

two slits, respectively connecting the receiving mountain-fold first ends of the two receiving mountain-fold lines and the receiving mountain-fold second ends of the two receiving mountain-fold lines;

a bottom located amongst the two receiving mountain-fold lines and the two slits, formed on the columnar wall and comprising two receiving valley-fold lines parallel to the two receiving mountain-fold lines.

* * * * *